US010988825B2

(12) United States Patent
Nakamura et al.

(10) Patent No.: US 10,988,825 B2
(45) **Date of Patent: *Apr. 27, 2021**

(54) MARTENSITIC STAINLESS STEEL SHEET

(71) Applicant: JFE STEEL CORPORATION, Tokyo (JP)

(72) Inventors: Tetsuyuki Nakamura, Tokyo (JP); Shin Ishikawa, Tokyo (JP); Chikara Kami, Tokyo (JP)

(73) Assignee: JFE STEEL CORPORATION, Chiyoda-ku Tokyo (JP)

( * ) Notice: Subject to any disclaimer, the term of this patent is extended or adjusted under 35 U.S.C. 154(b) by 161 days.

This patent is subject to a terminal disclaimer.

(21) Appl. No.: 16/090,649

(22) PCT Filed: Mar. 9, 2017

(86) PCT No.: PCT/JP2017/009578

§ 371 (c)(1),
(2) Date: Oct. 2, 2018

(87) PCT Pub. No.: WO2017/179346

PCT Pub. Date: Oct. 19, 2017

(65) Prior Publication Data

US 2019/0119775 A1 Apr. 25, 2019

(30) Foreign Application Priority Data

Apr. 12, 2016 (JP) ..... JP2016-079695

(51) Int. Cl.

| | |
|---|---|
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C22C 38/54*** | (2006.01) |
| ***C22C 38/58*** | (2006.01) |
| ***C21D 9/46*** | (2006.01) |
| ***C21D 6/00*** | (2006.01) |
| ***C21D 8/02*** | (2006.01) |

(52) U.S. Cl.

CPC ..... *C21D 9/46* (2013.01); *C21D 6/004* (2013.01); *C21D 6/005* (2013.01); *C21D 6/007* (2013.01); *C21D 6/008* (2013.01); *C21D 8/0205* (2013.01); *C22C 38/00* (2013.01); *C22C 38/001* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C22C 38/54* (2013.01); *C22C 38/58* (2013.01); *C21D 8/0226* (2013.01); *C21D 8/0236* (2013.01); *C21D 2211/008* (2013.01)

(58) Field of Classification Search

None

See application file for complete search history.

(56) References Cited

U.S. PATENT DOCUMENTS

| | | | | |
|---|---|---|---|---|
| 3,355,280 | A * | 11/1967 | Yeo | C22C 38/40 420/34 |
| 3,556,776 | A * | 1/1971 | Clarke, Jr. et al. | C22C 38/12 420/52 |
| 3,658,513 | A * | 4/1972 | Clarke, Jr. | C22C 38/42 420/38 |
| 3,660,176 | A * | 5/1972 | Denhard, Jr. | C21D 1/40 148/565 |
| 4,812,176 | A | 3/1989 | Tanaka et al. | |
| 4,824,491 | A | 4/1989 | Tanaka et al. | |
| 4,938,808 | A | 7/1990 | Miura et al. | |
| 5,178,693 | A | 1/1993 | Miyakusu et al. | |
| 5,433,798 | A * | 7/1995 | Takano | C22C 38/001 148/325 |
| 5,624,504 | A | 4/1997 | Miyakusu et al. | |
| 5,650,024 | A * | 7/1997 | Hasegawa | C21D 6/002 148/326 |

(Continued)

FOREIGN PATENT DOCUMENTS

| | | | |
|---|---|---|---|
| CN | 101426941 | A | 5/2009 |
| CN | 101906587 | A | 12/2010 |

(Continued)

OTHER PUBLICATIONS

"Introduction to Tensile Testing", ASM International, 2nd ed, p. 1-12 (Year: 2004).*

Mar. 13, 2019, the Extended European Search Report issued by the European Patent Office in the corresponding European Patent Application No. 17782164.2.

Apr. 17, 2020, Office Action issued by the China National Intellectual Property Administration in the corresponding Chinese Patent Application No. 201780016594.7 with English language concise statement of relevance.

(Continued)

*Primary Examiner* — Coris Fung
*Assistant Examiner* — Christopher D. Moody
(74) *Attorney, Agent, or Firm* — Kenja IP Law PC

(57) ABSTRACT

A martensitic stainless steel has a chemical composition containing, by mass %, C: 0.030% or more and less than 0.20%, Si: 0.01% or more and 2.0% or less, Mn: 0.01% or more and 3.0% or less, P: 0.050% or less , S: 0.010% or less, Cr: 10.0% or more and 16.0% or less, Ni: 0.01% or more and 0.80% or less, Al: 0.001% or more and 0.50% or less, Zr: 0.005% or more and 0.50% or less, and N: 0.030% or more and less than 0.20%, with the balance consisting of Fe and inevitable impurities.

1 Claim, No Drawings

(56) References Cited

U.S. PATENT DOCUMENTS

| | | | | |
|---|---|---|---|---|
| 6,277,215 | B1 | 8/2001 | Adachi et al. | |
| 6,386,342 | B1 | 5/2002 | Tsuge et al. | |
| 6,884,388 | B2 | 4/2005 | Ozaki et al. | |
| 8,607,941 | B2 | 12/2013 | Yamauchi et al. | |
| 8,852,361 | B2 | 10/2014 | Hirasawa et al. | |
| 9,523,402 | B2 | 12/2016 | Teraoka et al. | |
| 10,655,195 | B2 * | 5/2020 | Nakamura | C21D 6/004 |
| 2003/0138342 | A1 * | 7/2003 | Hirasawa | C22C 38/06 420/38 |
| 2004/0096352 | A1 | 5/2004 | Ozaki et al. | |
| 2004/0168750 | A1 * | 9/2004 | Tomimura | C21D 8/0205 148/325 |
| 2005/0274436 | A1 | 12/2005 | Kondo et al. | |
| 2006/0113008 | A1 * | 6/2006 | Hirasawa | C22C 38/48 148/325 |
| 2008/0069719 | A1 | 3/2008 | Beguinot et al. | |
| 2009/0104068 | A1 * | 4/2009 | Hirasawa | C22C 38/56 420/38 |
| 2009/0162240 | A1 | 6/2009 | Hirasawa et al. | |
| 2012/0125724 | A1 | 5/2012 | Yamauchi et al. | |
| 2013/0014864 | A1 * | 1/2013 | Teraoka | C22C 38/02 148/609 |
| 2014/0299239 | A1 | 10/2014 | Adachi et al. | |
| 2015/0101898 | A1 | 4/2015 | Teraoka et al. | |
| 2018/0112285 | A1 | 4/2018 | Nakamura et al. | |
| 2019/0119775 | A1 | 4/2019 | Nakamura et al. | |

FOREIGN PATENT DOCUMENTS

| | | | |
|---|---|---|---|
| CN | 102449181 | A | 5/2012 |
| CN | 104321456 | A | 1/2015 |
| EP | 1314791 | A1 | 5/2003 |
| EP | 1840237 | A1 | 10/2007 |
| EP | 2011891 | A1 | 1/2009 |
| EP | 2439304 | A1 | 4/2012 |
| JP | H02247360 | A | 10/1990 |
| JP | H0356621 | A | 3/1991 |
| JP | H07316740 | A | 12/1995 |
| JP | H08319519 | A | 12/1996 |
| JP | H10245656 | A | 9/1998 |
| JP | 2001140041 | A | 5/2001 |
| JP | 2002038243 | A | 2/2002 |
| JP | 2002097554 | A | 4/2002 |
| JP | 2002146488 | A | 5/2002 |
| JP | 2005054272 | A | 3/2005 |
| JP | 2006097050 | A | 4/2006 |
| JP | 2006322071 | A | 11/2006 |
| JP | 2007314815 | A | 12/2007 |
| JP | 2011012343 | A | 1/2011 |
| WO | 2012157680 | A1 | 11/2012 |
| WO | 2014123229 | A1 | 8/2014 |
| WO | 2016170761 | A1 | 10/2016 |

OTHER PUBLICATIONS

Mar. 30, 2020, Office Action issued by the Korean Intellectual Property Office in the corresponding Korean Patent Application No. 10-2018-7029446 with English language concise statement of relevance.

Oct. 23, 2019, Office Action issued by the China National Intellectual Property Administration in the corresponding Chinese Patent Application No. 201780016594.7 with English language search report.

May 30, 2017, International Search Report issued in the International Patent Application No. PCT/JP2017/009578.

ASM International, Introduction to Tensile Testing, Tensile Testing, Second Edition, 2004, pp. 1-12.

Bruce L. Bramfitt, Structure/Property Relationships in Irons and Steels, Metals Handbook Desk Edition, Second Edition, 1998, pp. 153-173.

Sep. 1, 2020, Office Action issued by the China National Intellectual Property Administration in the corresponding Chinese Patent Application No. 201780016594.7 with English language concise statement of relevance.

* cited by examiner

MARTENSITIC STAINLESS STEEL SHEET

TECHNICAL FIELD

The present disclosure relates to a martensitic stainless steel sheet excellent in strength, workability, and corrosion resistance.

BACKGROUND

Gaps between exhaust system parts of automobiles are sealed with sealing parts called gaskets for the purpose of preventing leakage of exhaust gas, cooling water, lubricating oil, and the like. Since a gasket must exhibit the sealing performance both in the case where the gap widens and in the case where the gap is narrowed due to the pressure fluctuation in the pipe or the like, a convex portion called the bead is formed in the gasket. As the bead is repeatedly compressed and relaxed during use, high strength is required. Depending on the shape of the bead, severe processing may be applied, and excellent workability is also required for the gasket material. Furthermore, since gaskets are exposed to exhaust gas, cooling water, and the like during use, corrosion resistance is also required. If the gasket material has insufficient corrosion-resistance, fracture may occur due to corrosion.

Conventionally austenitic stainless steels that have both a high strength and a high workability, such as SUS 301 (17 mass % Cr-7 mass % Ni) and SUS 304 (18 mass % Cr-8 mass % Ni), have been widely used. However, since austenitic stainless steels contain a large amount of expensive element Ni, they have a major problem in terms of material cost. Another problem is that austenitic stainless steels have high susceptibility to stress corrosion cracking.

Responding to these problems, there are proposals of martensitic stainless steels such as SUS403 (12 mass % Cr-0.13 mass % C), and stainless steels that comprise a multi-phase structure containing martensite. Both are inexpensive stainless steels because of a low content of Ni, and the strength thereof can be improved by quenching heat treatment.

For example, JP2002-38243A (PTL 1) describes a martensitic stainless steel and a martensite-ferrite dual phase stainless steel which are improved in fatigue resistance by nitriding the surface layer to form an austenite phase by quenching heat treatment in a nitrogen-containing atmosphere.

JP2005-54272A (PTL 2) describes a martensite-ferrite dual phase stainless steel which achieves both hardness and workability by quenching in a dual-phase temperature range of austenite and ferrite.

JP2002-97554A (PTL 3) describes a multi-phase stainless steel having a martensite and retained austenite phase in the surface layer and a martensite single phase in the inner layer after subjection to heat treatment in a nitrogen-containing atmosphere.

In addition, JPH3-56621A (PTL 4) describes a martensite-ferrite dual phase stainless steel improved in spring characteristics after subjection to multi-phase heat treatment followed by aging treatment.

JPH8-319519A (PTL 5) describes a martensite-ferrite dual phase stainless steel having the desired hardness by specifying the cold rolling rate.

JP2001-140041A (PTL 6) describes a stainless steel in which the surface layer is made of two phases of martensite and retained austenite.

JP2006-97050A (PTL 7) describes a stainless steel in which nitrogen is absorbed in SUS 403 or the like to precipitate a nitrogen compound in the surface layer.

JPH7-316740A (PTL 8) describes a multi-phase stainless steel in which a surface layer having a depth of at least 1 μm from the outermost surface is covered with a martensite single-phase layer.

CITATION LIST

Patent Literature

PTL 1: JP2002-38243A
PTL 2: JP2005-54272A
PTL 3: JP2002-97554A
PTL 4: JPH3-56621A
PTL 5: JPH8-319519A
PTL 6: JP2001-140041A
PTL 7: JP2006-97050A
PTL 8: JPH7-316740A

SUMMARY

Technical Problem

However, all of the stainless steels of PTLs 1 to 8 are insufficient to obtain workability and strength compatibly and may not satisfy the requirement for higher strength when the thickness is reduced for weight reduction.

As described above, the martensitic stainless steel is less susceptible to stress corrosion cracking and is inexpensive as compared with austenitic stainless steel in terms of cost, however, there is room for improvement in terms of both strength and workability.

It would be helpful to provide a martensitic stainless steel sheet that can achieve both excellent strength and workability and that can provide excellent corrosion resistance.

Solution to Problem

We conducted studies on the strength and workability of martensitic stainless steel sheets and obtained the following findings.

(1) For the parts subjected to locally severe processing such as the bead (convex portion) of the gasket, from workability perspective, it is effective to improve not only the elongation value but also the ultimate deformability in the tensile test.

(2) To suppress cracking during bead processing, it is effective to reduce coarse sulfides, since coarse sulfides such as MnS tend to be the starting point of cracking.

(3) In addition to reducing S, containing Zr is extremely effective in reducing coarse sulfides, which enables improving the ultimate deformability as well as the elongation such that cracking during bead processing can be suppressed.

The present disclosure is based on the above discoveries and our further studies.

Specifically, the primary features of the disclosure can be summarized as follows:

1. A martensitic stainless steel comprising a chemical composition containing (consisting of), by mass %, C: 0.030% or more and less than 0.20%, Si: 0.01% or more and 2.0% or less, Mn: 0.01% or more and 3.0% or less, P: 0.050% or less, S: 0.010% or less, Cr: 10.0% or more and 16.0% or less, Ni: 0.01% or more and 0.80% or less, Al: 0.001% or more and 0.50% or less, Zr: 0.005% or more and 0.50% or less, and N: 0.030% or more and less than 0.20%, with the balance consisting of Fe and inevitable impurities.

2. The martensitic stainless steel sheet according to 1. above, wherein the chemical composition further contains, by mass %, at least one selected from the group consisting of Cu: 0.01% or more and 3.0% or less, Mo: 0.01% or more and 0.50% or less, and Co: 0.01% or more and 0.50% or less.

3. The martensitic stainless steel sheet according to 1. or 2. above, wherein the chemical composition further contains, by mass %, at least one selected from the group consisting of Ti: 0.001% or more and 0.50% or less, Nb: 0.001% or more and 0.50% or less, and V: 0.001% or more and 0.50% or less.

4. The martensitic stainless steel sheet according to any one of 1. to 3. above, wherein the chemical composition further contains, by mass %, at least one selected from the group consisting of B: 0.0002% or more and 0.0100% or less, Ca: 0.0002% or more and 0.0100% or less, and Mg: 0.0002 or more and 0.0100% or less.

5. The martensitic stainless steel sheet according to any one of 1. to 4. above, having a tensile strength of 1300 MPa or more, an elongation of 7.0% or more, and an ultimate deformability of 0.5 or more.

Advantageous Effect

The present disclosure can provide a martensitic stainless steel sheet that is excellent in both strength and workability and that has excellent corrosion resistance not only when only quenching treatment is performed, but also when quenching and tempering treatment is carried out. Further, a martensitic stainless steel sheet of the present disclosure can be suitably used for gasket parts of automobiles.

DETAILED DESCRIPTION

The following provides details of the present disclosure.

First, the chemical composition of the stainless steel sheet according to the disclosure will be described. The % representations below indicating the chemical composition are in "mass %" unless stated otherwise.

C: 0.030% or more and less than 0.20%

C stabilizes the austenite phase at high temperature and increases the amount of martensite after quenching heat treatment. Increasing martensite content highly increases strength. In addition, C strengthens the steel by hardening the martensite itself. This effect is obtained when the C content is 0.030% or more. However, when the C content is 0.20% or more, the workability is significantly deteriorated, excellent elongation and ultimate deformability can not be obtained, and excellent strength-elongation balance can not be obtained. Furthermore, since C combines with Cr in the steel and precipitates as a carbide, if C is excessively increased, the amount of Cr dissolved in the steel decreases and the corrosion resistance of the steel decreases. Hereafter, unless otherwise specified, the amount of Cr dissolved in the steel is simply referred to as "Cr content in the steel". Therefore, the C content is set in a range of 0.030% or more and less than 0.20%. It is preferably more than 0.050%, and more preferably more than 0.100%. It is also preferably less than 0.160%, and more preferably less than 0.150%.

Si: 0.01% or more and 2.0% or less

Si is an effective element for increasing the strength of steel, and this effect is obtained when the Si content is 0.01% or more. However, Si is an element which facilitates formation of a ferrite phase at high temperature, and when its content exceeds 2.0%, the amount of martensite after quenching heat treatment decreases, and a predetermined strength can not be obtained. Therefore, the Si content is set in a range of 0.01% or more and 2.0% or less. It is preferably more than 0.10%, and more preferably greater than 0.30%. It is also preferably less than 1.00%, and more preferably less than 0.60%.

Mn: 0.01% or more and 3.0% or less

Mn is an element having the effect of stabilizing the austenite phase at high temperature, and it is possible to increase the amount of martensite after quenching heat treatment. It also has the effect of increasing the strength of steel. These effects are obtained when the Mn content is 0.01% or more. However, when the Mn content exceeds 3.0%, Mn precipitates in large amounts as coarse MnS, which not only deteriorates corrosion resistance but also significantly deteriorates workability. Therefore, the Mn content is set to 0.01% or more and 3.0% or less. It is preferably more than 0.10%, more preferably more than 0.30%, and further preferably more than 0.40%. It is also preferably less than 1.00%, more preferably less than 0.60%, and still more preferably less than 0.50%.

P: 0.050% or less

P is an element that deteriorates the toughness, and its content is preferably as small as possible, and the P content is set to 0.050% or less. It is preferably 0.040% or less. It is more preferably 0.030% or less. Although the lower limit for the P content is not particularly limited, it is usually about 0.010% considering the fact that excessive removal of P leads to an increase in manufacturing cost.

S: 0.010% or less

S is an element which not only deteriorates corrosion resistance but also significantly deteriorates workability. In order to obtain the desired workability in the present disclosure, the S content is preferably as small as possible, and is set to 0.010% or less. It is preferably 0.005% or less. More preferably, it is 0.003% or less.

By simply decreasing S, the effect of improving workability, particularly ultimate deformability, is limited. Therefore, as will be described later, in addition to reducing the S content, it is important to add Zr in a certain amount and to improve the ultimate deformability by synergistic effects of these.

Cr: 10.0% or more and 16.0% or less

Cr is an important element for securing corrosion resistance, and this effect is obtained when the Cr content is 10.0% or more.

However, when the Cr content exceeds 16.0%, the steel becomes hard and the manufacturability and workability are deteriorated. In addition, since a ferrite phase tends to be formed, the amount of martensite after quenching heat treatment decreases and sufficient strength can not be obtained. Therefore, the Cr content is set in a range of 10.0% or more and 16.0% or less. It is preferably 11.0% or more, and more preferably 12.0% or more. It is also preferably 14.0% or less, and more preferably 13.0% or less.

Ni: 0.01% or more and 0.80% or less

Ni is an element that stabilizes the austenite phase at high temperature and has the effect of increasing the amount of martensite after quenching heat treatment. In addition, it can contribute to increasing the strength of steel. These effects are obtained when the Ni content is 0.01% or more. However, when the amount of Ni exceeds 0.80%, the workability is deteriorated and an excellent strength-elongation balance can not be obtained. Therefore, the Ni content is set in a range of 0.01% or more and 0.80% or less. It is preferably more than 0.03%, and more preferably more than 0.05%. It is also preferably less than 0.50%, and more preferably less than 0.20%.

Al: 0.001% or more and 0.50% or less

Al is an effective element for deoxidization, and this effect is obtained when the Al content is 0.001% or more. However, Al is an element that stabilizes the ferrite phase at a high temperature. When the content exceeds 0.50%, a sufficient amount of martensite can not be formed after quenching heat treatment. Therefore, the Al content is set in a range of 0.001% or more and 0.50% or less. It is preferably 0.01% or more, and more preferably 0.02% or more. It is also preferably less than 0.35%, and more preferably less than 0.10%.

Zr: 0.005% or more and 0.50% or less

Zr is an element having an effect of suppressing precipitation of coarse sulfides such as MnS by combining with S and precipitating as a sulfide, thereby improving the ultimate deformability. In the present disclosure, in addition to the above-mentioned reduction of S, it is important to contain Zr in a predetermined amount and the ultimate deformability is improved by synergistic effects of these. That is, it is possible to suppress precipitation of coarse sulfides such as MnS by reducing the S content and precipitating S remaining in the steel as ZrS by containing Zr, which makes it possible to improve workability, in particular ultimate deformability. This effect is obtained when the Zr content is 0.005% or more. However, a Zr content beyond 0.50% leads to coarsening of Zr sulfides, which deteriorates workability. Therefore, the Zr content is set in a range of 0.005% or more and 0.50% or less. It is preferably 0.01% or more, and more preferably 0.02% or more. It is also preferably 0.20% or less, and more preferably 0.05% or less.

From the viewpoint of more effectively precipitating S remaining in the steel as ZrS, it is preferable to satisfy the relation of Zr %≥3*S % for Zr and S. Here, Zr % and S % represent the content by mass % of Zr and S in the steel, respectively.

N: 0.030% or more and less than 0.20%

Like C, N stabilizes the austenite phase at high temperature, increases the amount of martensite after quenching heat treatment, and hardens martensite itself to strengthen the steel. In order to obtain high strength, it is necessary to contain N in an amount of 0.030% or more. However, when the N content is 0.20% or more, workability (elongation and ultimate deformability) significantly deteriorates. Therefore, the N content is set in a range of 0.030% or more and less than 0.20%. It is preferably more than 0.030%, and more preferably more than 0.040%. It is also preferably less than 0.150%, and more preferably less than 0.100%.

In addition to the basic components have been described above, the stainless steel sheet disclosed herein may optionally contain at least one of:

at least one selected from the group consisting of Cu, Mo, and Co;

at least one selected from the group consisting of Ti, Nb, and V; or at least one selected from the group consisting of B, Ca, and Mg.

The respective ranges are as stated below.

Cu: 0.01% or more and 3.0% or less

During cooling in the quenching heat treatment, Cu precipitates finely in the steel and make the steel have high proof stress and high strength. On the other hand, since Cu precipitates finely, there is harmful influence on workability (elongation). The effect of increasing the proof stress and the strength is obtained when the Cu content is 0.01% or more. However, when the Cu content exceeds 3.0%, not only the effect of increasing the strength is saturated, but also coarse Cu precipitates, and the steel becomes hard and workability deteriorates. Therefore, when Cu is contained, the Cu content is set in a range of 0.01% or more and 3.0% or less. It is preferably 0.05% or more, and more preferably more than 0.40%. It is preferably 2.00% or less, and more preferably 1.00% or less.

Mo: 0.01% or more and 0.50% or less

Mo is an element which increases the strength of steel by solid solution strengthening, and this effect is obtained when the Mo content is 0.01% or more. However, Mo is an expensive element, and when its content exceeds 0.50%, the workability of the steel deteriorates. Therefore, when Mo is contained, the Mo content is set in a range of 0.01% or more and 0.50% or less. It is preferably 0.02% or more. It is also preferably less than 0.25%.

Co: 0.01% or more and 0.50% or less

Co is an element which improves the strength and toughness of steel and this effect is obtained when the Co content is 0.01% or more. On the other hand, Co is an expensive element, and when its content exceeds 0.50%, not only the above effect is saturated but also the workability is deteriorated. Therefore, when Co is contained, it is set in a range of 0.01% or more and 0.50% or less. It is preferably 0.02% or more. It is also preferably less than 0.25%, and more preferably less than 0.10%.

Ti: 0.001% or more and 0.50% or less

Ti combines with C and precipitate as a carbide, and combines with N and precipitate as a nitride, thereby suppressing the formation of Cr carbides and Cr nitrides during cooling after quenching heat treatment, thereby improving the corrosion resistance of the steel. This effect is obtained when the Ti content is 0.001% or more. On the other hand, when the Ti content exceeds 0.50%, coarse Ti nitride precipitates and the toughness of steel deteriorates. Therefore, when Ti is contained, the Ti content is set in a range of 0.001% or more and 0.50% or less. It is preferably 0.01% or more. It is also preferably less than 0.25%.

Nb: 0.001% or more and 0.50% or less

Nb preferentially combines with C dissolved in the steel and precipitate as a carbide, which suppresses the formation of Cr carbide and improves the corrosion resistance effectively. This effect is obtained when the Nb content is 0.001% or more. On the other hand, when the Nb content exceeds 0.50%, the amount of Nb carbide excessively increases, the amount of C in the steel decreases, and sufficient strength can not be obtained. Therefore, when Nb is contained, the Nb content is set in a range of 0.001% or more and 0.50% or less. It is preferably at least 0.01%, and more preferably at least 0.02%. It is also preferably less than 0.20%, and more preferably less than 0.10%.

V: 0.001% or more and 0.50% or less

V preferentially combines with N dissolved in the steel and precipitate as a nitride, which suppresses the formation of Cr nitride and improves the corrosion resistance effectively. This effect is obtained when the V content is 0.001% or more. On the other hand, when the V content exceeds 0.50%, the amount of V nitride generated excessively increases, the amount of N in the steel decreases, and sufficient strength can not be obtained. Therefore, when V is contained, the V content is set in a range of 0.001% or more and 0.50% or less. It is preferably 0.01% or more, and more preferably 0.02% or more. It is also preferably less than 0.30%, and more preferably less than 0.10%.

B: 0.0002% or more and 0.0100% or less

B is an effective element for improving workability. This effect is obtained when the B content is 0.0002% or more. On the other hand, when the B content exceeds 0.0100%, the workability and toughness of the steel are deteriorated. Since B combines with N in the steel and precipitate as a nitride, the amount of martensite decreases and the strength of the steel decreases. Therefore, when B is contained, the B content is set in a range of 0.0002% or more and 0.0100% or less. It is preferably 0.0005% or more, and more preferably 0.0010% or more. It is also preferably less than 0.0050%, and more preferably less than 0.0030%.

Ca: 0.0002% or more and 0.0100% or less

Ca is an effective component for preventing clogging of the nozzle that would otherwise easily occur due to precipitation of inclusions generated during continuous casting. This effect is obtained by containing 0.0002% or more of Ca. On the other hand, when the Ca content exceeds 0.0100%, surface defects occur. Therefore, when Ca is contained, the Ca content is set in a range of 0.0002% to 0.0100%. It is preferably 0.0005% or more. It is also preferably less than 0.0030%, and more preferably less than 0.0020%.

Mg: 0.0002% or more and 0.0100% or less

Mg is an effective element for suppressing coarsening of carbide and nitride. When coarse carbide and nitride precipitates are formed, they become the origin of brittle fracture, deteriorating the toughness. The toughness improving effect is obtained when the Mg content is 0.0002% or more. On the other hand, when the Mg content exceeds 0.0100%, the surface characteristics of steel deteriorates. Therefore, when Mg is contained, the Mg content is set in a range of 0.0002% or more and 0.0100% or less. It is preferably 0.0005% or more. It is also preferably less than 0.0030%, and more preferably less than 0.0020%.

The components other than the above are Fe and inevitable impurities. Specifically, the chemical composition consists of, by mass %, C: 0.030% or more and less than 0.20%,
Si: 0.01% or more and 2.0% or less,
Mn: 0.01% or more and 3.0% or less,
P: 0.050% or less,
S: 0.010% or less,
Cr: 10.0% or more to 16.0% or less,
Ni: 0.01% or more and 0.80% or less,
Al: 0.001% or more and 0.50% or less,
Zr: 0.005% or more and 0.50% or less, and
N: 0.030% or more and less than 0.20%, and optionally at least one of:
at least one selected from the group consisting of
Cu: 0.01% or more and 3.0% or less,
Mo: 0.01% or more and 0.50% or less, and
Co: 0.01% or more and 0.50% or less;
at least one selected from the group consisting of
Ti: 0.001% or more and 0.50% or less,
Nb: 0.001% or more and 0.50% or less, and
V: 0.001% or more and 0.50% or less; or
at least one selected from the group consisting of
B: 0.0002% or more and 0.0100% or less,
Ca: 0.0002% or more and 0.0100% or less, and
Mg: 0.0002% or more and 0.0100% or less,
with the balance consisting of Fe and inevitable impurities.

Further, in order to obtain a high-strength material of 1300 MPa or more, the martensitic stainless steel sheet of the present disclosure has a structure mainly composed of a martensite phase, specifically, a structure containing 80% or more of a martensite phase with the remainder consisting of a ferrite phase and/or a retained austenite phase. It is preferable that martensite accounts for 90% or more of the structure in volume ratio, including a martensite single phase.

The volume ratio of the martensite phase can be determined as follows: a test piece is prepared from a final cold-rolled sheet (either as quenched or quenched and tempered) and etched with aqua regia, then through cross-section observation under an optical microscope for 10 observation fields at 200 times magnification, martensite phase is distinguished from ferrite phase and retained austenite phase in accordance with the microstructure shape and etching strength, the volume ratio of the martensite phase is determined by image processing, the results are averaged, and the average is used as the volume ratio of the martensite phase.

The following describes a suitable production method for the presently disclosed martensitic stainless steel.

The martensitic stainless steel sheet of the present disclosure is produced by preparing a steel having the above chemical composition through steelmaking in a melting furnace such as a converter or an electric furnace, subjecting it to secondary refining such as ladle refining or vacuum refining, followed by either continuous casting or ingot casting and blooming to obtain a semi-finished product (slab), and subjecting the slab to hot rolling, hot band annealing, and pickling to obtain a hot-rolled and annealed sheet. Further, the method may also include cold rolling, quenching heat treatment, and other optional steps such as pickling and tempering heat treatment to obtain a cold-rolled sheet.

For example, molten steel is prepared by steelmaking in a converter or an electric furnace, secondary refining is carried out by VOD method or AOD method to obtain the above chemical composition, and a slab is formed by continuous casting. The slab thus obtained is heated to 1000° C. to 1250° C. and hot rolled into a hot-rolled sheet of a desired thickness. The hot-rolled sheet is subjected to batch annealing at a temperature of 600° C. to 800° C., and then the oxide scale is removed by shot blasting and pickling to obtain a hot-rolled and annealed sheet. This hot-rolled and annealed sheet is further cold rolled, quenched, and cooled to obtain a cold-rolled sheet. In the cold rolling, two or more cold rolling steps including intermediate annealing may be performed if necessary. The total rolling reduction in the cold rolling including one or more cold rolling steps is set to 60% or more, and preferably 80% or more. From the viewpoint of obtaining desired mechanical properties (such as strength, 0.2% proof stress, elongation, and ultimate deformability), it is preferable to perform the quenching heat treatment in a range of 900° C. to 1200° C. The range is more preferably 1000° C. or higher. The range is more preferably 1100° C. or lower. The cooling rate after the quenching heat treatment is preferably 1° C./sec or more in order to obtain a desired strength. After cooling subsequent to the quenching heat treatment, tempering heat treatment may be carried out as necessary. It is preferable to perform the tempering heat treatment in a range of 100° C. to 500° C. from the viewpoint of obtaining desired properties. The range is more preferably 200° C. or higher. The range is more preferably 300° C. or lower. Further, after the quenching heat treatment and tempering heat treatment, pickling treatment may be carried out. In addition, BA finishing may be performed without pickling by performing quenching heat treatment and tempering heat treatment in a reducing atmosphere containing hydrogen.

The cold-rolled sheet product thus produced is subjected to bending processing, bead processing, drilling processing, or the like according to the use, and formed into gasket parts or the like used as a sealing material between the engine and the exhaust system parts of the automobile. The cold-rolled sheet product may also be used for members requiring springiness. If necessary, the cold-rolled sheet product may be subjected to quenching heat treatment and tempering heat treatment after formed into parts.

EXAMPLES 30 kg steel ingots having the chemical compositions listed in Table 1 were prepared by steelmaking and casting in a vacuum melting furnace. In each case, after heating to 1200° C., hot rolling was performed to obtain a sheet bar having a thickness of 25 mm and a width of 150 mm. The sheet bar was softened by being held in the furnace at 700° C. for 10 hours. Then, the sheet bar was heated to 1100° C. and hot rolled to obtain a hot-rolled sheet having a thickness of 4 mm. Then, the hot-rolled sheet was annealed in the furnace at 700° C. for 10 hours to obtain a hot-rolled and annealed sheet. Subsequently, the hot-rolled annealed sheet was cold-rolled into a cold-rolled sheet having a thickness of 0.2 mm, subjected to quenching heat treatment at a temperature in Table 2, and then cooled. At this time, the cooling rate was set to 1° C./sec or more in each case. Further, some of the cold-rolled sheets were cooled after the quenching heat treatment, and then subjected to tempering heat treatment at the temperatures listed in Table 2.

<Microstructure Observation>

For each cold-rolled martensitic stainless steel sheet (either as-quenched or quenched and tempered), a test piece was prepared for cross-section observation, etched with aqua regia, then through cross-section observation under an optical microscope for 10 observation fields at 200 times magnification, martensite phase was distinguished from ferrite phase in accordance with the shape and etching strength, the volume ratio of the martensite phase was determined by image processing, and the results were averaged. In Steel Nos. 1 to 22 and 31 to 47 of our examples and Steel Nos. 23 to 28, 30, and 48 to 50 of comparative examples, the martensite phase accounted for 80% or more of the entire structure in volume ratio. On the other hand, in Steel No. 29 of comparative example in which the Cr content was high, the martensite phase accounted for less than 80% of the entire structure in volume ratio.

<Tensile Test>

Using the cold-rolled martensitic stainless steel sheets prepared as described above (either as-quenched or quenched and tempered), JIS No. 5 tensile test pieces whose longitudinal direction was the rolling direction were prepared, and subjected to room temperature tensile tests according to JIS Z 2241 to measure tensile strength (T.S.), 0.2% proof stress (P.S.), elongation (EL), and ultimate deformability ($\varepsilon_1$). The original gauge distance was 50 mm and the tensile speed was 10 mm/min. Each steel was tested with N=2, and the average value was evaluated.

The elongation (EL) was calculated by the following formula by butting deeply the divided test pieces such that the axes of the test pieces were on a straight line, and measuring the final gauge distance:

$$EL\ (\%)=(L_u-L_0)/L_0*100$$

where EL is the elongation (elongation after fracture), $L_0$ is the original gauge distance, and $L_u$ is the final gauge distance.

The sheet width W and the sheet thickness T on the fractured surface of each tensile test piece after the tensile test were measured, and the ultimate deformability $\varepsilon_1$ was calculated by the following formula together with the sheet width $W_0$ and the sheet thickness $T_0$ of the tensile test piece before the tensile test:

$$\varepsilon_1=-\{ln(W/W_0)+ln(T/T_0)\}$$

where $\varepsilon_1$ is the ultimate deformability, W is the sheet width on the fractured surface of the tensile test piece after the tensile test, $W_0$ is the sheet width of the tensile test piece before the tensile test, T is the sheet thickness on the fractured surface of the tensile test piece after the tensile test, and $T_0$ is the sheet thickness of the tensile test piece before the tensile test.

The evaluation results are also listed in Table 2. The evaluation criteria are as follows:

Tensile strength (T.S.)
Good: passed, 1300 MPa or more
Poor: failed, less than 1300 MPa
0.2% proof stress (P.S.)
Good: passed, 1050 MPa or more
Poor: failed, less than 1050 MPa
Elongation (EL)
Good: passed, 7.0% or more
Poor: failed, less than 7.0%
Ultimate deformability ($\varepsilon_1$)
Good: passed, 0.5 or more
Poor: failed, less than 0.5

<Corrosion Resistance Evaluation Test>

A test piece of 60 mm wide and 80 mm long was cut out from each cold-rolled sheet prepared as described above (either as-quenched or quenched and tempered) and subjected to a corrosion resistance evaluation test following the corrosion test method for automotive materials (JASO M 609-91) as specified by the Society of Automotive Engineers of Japan. The surface of each test piece was polished with #600 emery paper. In each test piece the entire back surface and 5 mm around the front surface were covered with a seal. In the test, the corrosion area ratio of the surface was measured after 15 cycles with one cycle being 5% salt spray (2 hours), 60° C. drying (4 hours), and 50° C. wetting (2 hours). The test was performed with N=2, and the one with the larger corrosion area ratio was adapted as the evaluation of the cold-rolled sheet.

The obtained results are also listed in Table 2. The evaluation criteria are as follows:

Good: passed, where the corrosion area ratio was less than 30%
Poor: failed, where the corrosion area ratio was 30% or more

TABLE 1

| Steel No. | Chemical Composition (mass %) C | Si | Mn | P | S | Cr | Ni | Al | Zr | N | Cu | Mo |
|---|---|---|---|---|---|---|---|---|---|---|---|---|
| 1 | 0.131 | 0.36 | 0.43 | 0.026 | 0.001 | 12.6 | 0.09 | 0.002 | 0.03 | 0.038 | — | — |
| 2 | 0.138 | 0.49 | 0.17 | 0.035 | 0.001 | 11.8 | 0.19 | 0.003 | 0.04 | 0.077 | — | — |
| 3 | 0.133 | 0.41 | 0.42 | 0.026 | 0.002 | 10.6 | 0.12 | 0.002 | 0.07 | 0.088 | — | — |
| 4 | 0.116 | 0.41 | 0.54 | 0.028 | 0.006 | 11.5 | 0.08 | 0.003 | 0.04 | 0.067 | — | — |
| 5 | 0.119 | 0.37 | 0.41 | 0.028 | 0.002 | 12.4 | 0.18 | 0.001 | 0.18 | 0.052 | — | — |
| 6 | 0.129 | 0.35 | 0.24 | 0.033 | 0.002 | 12.3 | 0.19 | 0.004 | 0.03 | 0.073 | — | — |
| 7 | 0.119 | 0.26 | 1.55 | 0.031 | 0.002 | 11.8 | 0.10 | 0.005 | 0.06 | 0.079 | — | — |
| 8 | 0.105 | 0.87 | 0.53 | 0.037 | 0.001 | 11.3 | 0.16 | 0.003 | 0.09 | 0.069 | — | — |
| 9 | 0.145 | 0.41 | 0.14 | 0.035 | 0.001 | 13.4 | 0.07 | 0.290 | 0.06 | 0.040 | — | — |
| 10 | 0.143 | 0.18 | 0.36 | 0.031 | 0.001 | 12.0 | 0.11 | 0.005 | 0.09 | 0.061 | 2.50 | — |
| 11 | 0.142 | 0.27 | 0.41 | 0.029 | 0.001 | 11.0 | 0.14 | 0.003 | 0.02 | 0.064 | — | — |
| 12 | 0.113 | 0.16 | 0.15 | 0.037 | 0.002 | 12.5 | 0.09 | 0.003 | 0.02 | 0.078 | — | 0.09 |
| 13 | 0.149 | 0.54 | 0.49 | 0.032 | 0.001 | 11.7 | 0.15 | 0.005 | 0.04 | 0.054 | — | — |
| 14 | 0.117 | 0.29 | 0.57 | 0.036 | 0.001 | 10.6 | 0.05 | 0.005 | 0.03 | 0.059 | — | — |
| 15 | 0.148 | 0.59 | 0.57 | 0.029 | 0.002 | 12.0 | 0.16 | 0.002 | 0.08 | 0.088 | — | — |
| 16 | 0.126 | 0.23 | 0.56 | 0.038 | 0.001 | 13.2 | 0.12 | 0.002 | 0.06 | 0.068 | — | — |
| 17 | 0.105 | 0.17 | 0.12 | 0.025 | 0.002 | 13.1 | 0.10 | 0.005 | 0.02 | 0.054 | — | — |
| 18 | 0.118 | 0.19 | 0.40 | 0.040 | 0.001 | 10.7 | 0.06 | 0.003 | 0.09 | 0.060 | — | — |
| 19 | 0.107 | 0.29 | 0.32 | 0.033 | 0.002 | 11.9 | 0.06 | 0.002 | 0.06 | 0.067 | — | — |
| 20 | 0.115 | 0.58 | 0.43 | 0.031 | 0.002 | 12.2 | 0.08 | 0.005 | 0.04 | 0.064 | — | 0.33 |
| 21 | 0.127 | 0.27 | 0.21 | 0.035 | 0.001 | 13.4 | 0.15 | 0.004 | 0.07 | 0.083 | — | — |
| 22 | 0.130 | 0.23 | 0.15 | 0.039 | 0.001 | 11.7 | 0.08 | 0.004 | 0.05 | 0.063 | — | — |
| 23 | 0.128 | 0.35 | 0.46 | 0.020 | 0.004 | 12.7 | 0.07 | 0.003 | — | 0.031 | — | — |
| 24 | 0.145 | 0.17 | 0.60 | 0.038 | 0.002 | 9.1 | 0.14 | 0.006 | 0.05 | 0.047 | — | — |
| 25 | 0.148 | 0.56 | 0.27 | 0.035 | 0.001 | 11.7 | 0.10 | 0.005 | 0.04 | 0.024 | — | — |
| 26 | 0.024 | 0.51 | 0.33 | 0.037 | 0.001 | 12.4 | 0.15 | 0.002 | 0.03 | 0.075 | — | — |
| 27 | 0.222 | 0.48 | 0.33 | 0.035 | 0.001 | 11.8 | 0.09 | 0.004 | 0.03 | 0.074 | — | — |
| 28 | 0.109 | 0.21 | 0.25 | 0.030 | 0.001 | 11.1 | 0.10 | 0.006 | 0.04 | 0.236 | — | — |
| 29 | 0.135 | 0.37 | 0.35 | 0.039 | 0.001 | 17.3 | 0.13 | 0.003 | 0.07 | 0.071 | — | — |
| 30 | 0.147 | 0.30 | 0.47 | 0.027 | 0.015 | 13.7 | 0.05 | 0.003 | 0.09 | 0.049 | — | — |
| 31 | 0.127 | 0.28 | 0.97 | 0.031 | 0.002 | 12.9 | 0.11 | 0.005 | 0.01 | 0.042 | — | — |
| 32 | 0.138 | 0.40 | 0.34 | 0.029 | 0.002 | 12.5 | 0.12 | 0.004 | 0.03 | 0.040 | 0.37 | — |
| 33 | 0.130 | 0.33 | 0.51 | 0.030 | 0.001 | 11.9 | 0.15 | 0.002 | 0.04 | 0.029 | — | — |
| 34 | 0.118 | 0.39 | 0.39 | 0.031 | 0.002 | 12.2 | 0.08 | 0.003 | 0.05 | 0.036 | — | — |
| 35 | 0.141 | 0.44 | 0.31 | 0.028 | 0.002 | 12.6 | 0.17 | 0.005 | 0.04 | 0.050 | — | — |
| 36 | 0.122 | 0.35 | 0.46 | 0.029 | 0.001 | 11.5 | 0.10 | 0.005 | 0.02 | 0.038 | — | — |
| 37 | 0.131 | 0.32 | 0.44 | 0.030 | 0.002 | 12.3 | 0.14 | 0.004 | 0.03 | 0.043 | — | — |
| 38 | 0.126 | 0.41 | 0.32 | 0.030 | 0.002 | 12.4 | 0.12 | 0.004 | 0.05 | 0.037 | — | 0.15 |
| 39 | 0.137 | 0.33 | 0.47 | 0.031 | 0.001 | 12.7 | 0.10 | 0.005 | 0.02 | 0.033 | — | — |
| 40 | 0.129 | 0.39 | 0.40 | 0.029 | 0.002 | 12.4 | 0.09 | 0.003 | 0.03 | 0.040 | — | 0.02 |
| 41 | 0.189 | 0.27 | 2.83 | 0.030 | 0.002 | 11.9 | 0.07 | 0.008 | 0.05 | 0.048 | — | — |
| 42 | 0.048 | 0.48 | 0.39 | 0.031 | 0.001 | 13.4 | 0.12 | 0.020 | 0.03 | 0.106 | — | — |
| 43 | 0.077 | 1.81 | 0.51 | 0.028 | 0.002 | 12.8 | 0.79 | 0.440 | 0.02 | 0.173 | — | — |
| 44 | 0.106 | 0.36 | 0.44 | 0.033 | 0.002 | 15.2 | 0.20 | 0.018 | 0.38 | 0.055 | — | — |
| 45 | 0.112 | 1.34 | 0.78 | 0.030 | 0.002 | 12.7 | 0.09 | 0.013 | 0.08 | 0.098 | — | — |
| 46 | 0.127 | 0.30 | 0.50 | 0.028 | 0.008 | 11.8 | 0.08 | 0.005 | 0.05 | 0.041 | — | — |
| 47 | 0.133 | 0.41 | 0.44 | 0.030 | 0.007 | 12.0 | 0.17 | 0.008 | 0.01 | 0.042 | — | — |
| 48 | 0.120 | 0.54 | 0.43 | 0.029 | 0.012 | 12.3 | 0.13 | 0.015 | 0.06 | 0.038 | — | — |
| 49 | 0.131 | 0.35 | 0.40 | 0.032 | 0.011 | 12.8 | 0.20 | 0.003 | 0.14 | 0.035 | — | — |
| 50 | 0.141 | 0.45 | 0.38 | 0.028 | 0.002 | 12.1 | 0.10 | 0.006 | — | 0.036 | — | — |

| Steel No. | Chemical Composition (mass %) Co | Ti | Nb | V | B | Ca | Mg | Remarks |
|---|---|---|---|---|---|---|---|---|
| 1 | — | — | — | — | — | — | — | Example |
| 2 | — | — | — | — | — | — | — | Example |
| 3 | — | — | — | — | — | — | — | Example |
| 4 | — | — | — | — | — | — | — | Example |
| 5 | — | — | — | — | — | — | — | Example |
| 6 | — | — | — | — | — | — | — | Example |
| 7 | — | — | — | — | — | — | — | Example |
| 8 | — | — | — | — | — | — | — | Example |
| 9 | — | — | — | — | — | — | — | Example |
| 10 | — | — | — | — | — | — | — | Example |
| 11 | — | 0.05 | — | — | — | — | — | Example |
| 12 | — | — | — | — | — | — | — | Example |
| 13 | — | — | 0.03 | — | — | — | — | Example |
| 14 | — | — | — | 0.21 | — | — | — | Example |
| 15 | — | — | — | — | 0.0009 | — | — | Example |
| 16 | — | — | — | — | — | — | 0.0008 | Example |
| 17 | — | — | — | — | — | 0.0011 | — | Example |
| 18 | 0.04 | — | — | — | — | — | — | Example |
| 19 | — | — | 0.02 | 0.05 | — | — | — | Example |
| 20 | — | — | — | — | 0.0021 | — | — | Example |
| 21 | — | — | — | — | — | 0.0012 | 0.0010 | Example |

TABLE 1-continued

| | | | | | | | | |
|---|---|---|---|---|---|---|---|---|
| 22 | 0.03 | — | — | 0.04 | — | — | — | Example |
| 23 | — | — | — | — | — | — | — | Comparative Example |
| 24 | — | — | — | — | — | — | — | Comparative Example |
| 25 | — | — | — | — | — | — | — | Comparative Example |
| 26 | — | — | — | — | — | — | — | Comparative Example |
| 27 | — | — | — | — | — | — | — | Comparative Example |
| 28 | — | — | — | — | — | — | — | Comparative Example |
| 29 | — | — | — | — | — | — | — | Comparative Example |
| 30 | — | — | — | — | — | — | — | Comparative Example |
| 31 | — | — | 0.19 | — | — | — | — | Example |
| 32 | — | — | — | — | — | — | — | Example |
| 33 | — | — | — | 0.11 | — | — | — | Example |
| 34 | — | — | 0.05 | — | — | — | — | Example |
| 35 | 0.18 | — | — | — | — | — | — | Example |
| 36 | — | — | — | 0.14 | — | — | — | Example |
| 37 | — | 0.12 | — | — | — | — | — | Example |
| 38 | — | — | — | — | — | — | — | Example |
| 39 | — | — | 0.04 | 0.21 | — | — | — | Example |
| 40 | — | — | 0.03 | — | — | — | — | Example |
| 41 | — | — | — | — | 0.0008 | 0.0010 | 0.0011 | Example |
| 42 | — | — | — | — | 0.0011 | 0.0013 | — | Example |
| 43 | — | — | — | — | — | — | — | Example |
| 44 | — | — | — | — | — | — | — | Example |
| 45 | — | — | — | — | 0.0013 | — | 0.0009 | Example |
| 46 | — | — | — | — | — | — | — | Example |
| 47 | — | — | — | — | — | — | — | Example |
| 48 | — | — | — | — | — | — | — | Comparative Example |
| 49 | — | — | — | — | — | — | — | Comparative Example |
| 50 | — | — | — | — | — | — | — | Comparative Example |

TABLE 2

| | Production conditions | | Evaluation results | | | | | |
|---|---|---|---|---|---|---|---|---|
| Steel No. | Quenching temp. (° C.) | Tempering temp. (° C.) | Tensile strength | 0.2% proof stress | Elongation | Ultimate deformability | Corrosion resistance | Remarks |
| 1 | 1030 | 300 | Good | Good | Good | Good | Good | Example |
| 2 | 1000 | — | Good | Good | Good | Good | Good | Example |
| 3 | 1000 | 400 | Good | Good | Good | Good | Good | Example |
| 4 | 1050 | — | Good | Good | Good | Good | Good | Example |
| 5 | 1030 | — | Good | Good | Good | Good | Good | Example |
| 6 | 1000 | — | Good | Good | Good | Good | Good | Example |
| 7 | 1030 | — | Good | Good | Good | Good | Good | Example |
| 8 | 1050 | 100 | Good | Good | Good | Good | Good | Example |
| 9 | 1080 | — | Good | Good | Good | Good | Good | Example |
| 10 | 1000 | 500 | Good | Good | Good | Good | Good | Example |
| 11 | 1000 | 200 | Good | Good | Good | Good | Good | Example |
| 12 | 1030 | — | Good | Good | Good | Good | Good | Example |
| 13 | 1030 | 300 | Good | Good | Good | Good | Good | Example |
| 14 | 1050 | — | Good | Good | Good | Good | Good | Example |
| 15 | 1000 | — | Good | Good | Good | Good | Good | Example |
| 16 | 1030 | — | Good | Good | Good | Good | Good | Example |
| 17 | 1000 | — | Good | Good | Good | Good | Good | Example |
| 18 | 1050 | — | Good | Good | Good | Good | Good | Example |
| 19 | 1050 | 200 | Good | Good | Good | Good | Good | Example |
| 20 | 1080 | — | Good | Good | Good | Good | Good | Example |
| 21 | 1080 | — | Good | Good | Good | Good | Good | Example |
| 22 | 1030 | — | Good | Good | Good | Good | Good | Example |
| 23 | 1030 | — | Good | Good | Poor | Poor | Poor | Comparative Example |
| 24 | 1000 | — | Good | Good | Good | Good | Poor | Comparative Example |
| 25 | 1030 | — | Poor | Poor | Good | Good | Good | Comparative Example |
| 26 | 1030 | 200 | Poor | Poor | Good | Good | Good | Comparative Example |
| 27 | 1080 | — | Good | Good | Poor | Poor | Poor | Comparative Example |
| 28 | 1030 | 300 | Good | Good | Poor | Poor | Poor | Comparative Example |
| 29 | 1050 | — | Poor | Poor | Good | Good | Good | Comparative Example |
| 30 | 1050 | — | Good | Good | Good | Poor | Poor | Comparative Example |
| 31 | 1030 | — | Good | Good | Good | Good | Good | Example |
| 32 | 1050 | 200 | Good | Good | Good | Good | Good | Example |
| 33 | 1030 | 300 | Good | Good | Good | Good | Good | Example |
| 34 | 1000 | 200 | Good | Good | Good | Good | Good | Example |
| 35 | 1030 | 300 | Good | Good | Good | Good | Good | Example |
| 36 | 1000 | 300 | Good | Good | Good | Good | Good | Example |
| 37 | 1050 | 300 | Good | Good | Good | Good | Good | Example |
| 38 | 1050 | 200 | Good | Good | Good | Good | Good | Example |
| 39 | 1030 | 300 | Good | Good | Good | Good | Good | Example |

TABLE 2-continued

| | Production conditions | | Evaluation results | | | | | |
|---|---|---|---|---|---|---|---|---|
| Steel No. | Quenching temp. (° C.) | Tempering temp. (° C.) | Tensile strength | 0.2% proof stress | Elongation | Ultimate deformability | Corrosion resistance | Remarks |
| 40 | 1030 | 200 | Good | Good | Good | Good | Good | Example |
| 41 | 1080 | 300 | Good | Good | Good | Good | Good | Example |
| 42 | 1050 | 200 | Good | Good | Good | Good | Good | Example |
| 43 | 1030 | 300 | Good | Good | Good | Good | Good | Example |
| 44 | 1050 | 300 | Good | Good | Good | Good | Good | Example |
| 45 | 1080 | 200 | Good | Good | Good | Good | Good | Example |
| 46 | 1030 | 300 | Good | Good | Good | Good | Good | Example |
| 47 | 1030 | 300 | Good | Good | Good | Good | Good | Example |
| 48 | 1030 | 300 | Good | Good | Good | Poor | Poor | Comparative Example |
| 49 | 1030 | 300 | Good | Good | Good | Poor | Poor | Comparative Example |
| 50 | 1030 | 300 | Good | Good | Poor | Poor | Poor | Comparative Example |

From Table 1, it can be seen that examples Nos. 1 to 22 and 31 to 47 were all excellent in strength, 0.2% proof stress, elongation, ultimate deformability, and corrosion resistance.

On the other hand, comparative examples Nos. 23 and 50 containing no Zr (both corresponding to SUS 403) failed in terms of elongation, ultimate deformability, and corrosion resistance. Comparative example No. 24 with Cr content as low as outside the appropriate range failed in terms of corrosion resistance. Comparative example No. 25 with N content as low as outside the appropriate range and comparative example No. 26 with C content as low as outside the appropriate range failed in terms of strength and 0.2% proof stress. Comparative example No. 27 with C content as high as outside the appropriate range and comparative example No. 28 with N content as high as outside the appropriate range failed in terms of elongation, ultimate deformability, and corrosion resistance. Comparative example No. 29 with Cr content as high as outside the appropriate range and with less martensite failed in terms of strength and 0.2% proof stress. Comparative examples Nos. 30, 48, and 49 with S content as high as outside the appropriate range failed in terms of ultimate deformability and corrosion resistance.

INDUSTRIAL APPLICABILITY

The martensitic stainless steel sheet disclosed herein is excellent in both strength (tensile strength and 0.2% proof stress) and workability (elongation, in particular, ultimate deformability), and is therefore suitable as a gasket member. It is also suitable for use in parts requiring spring resistance.

The invention claimed is:

1. A martensitic stainless steel sheet comprising a chemical composition consisting of, by mass %, C: 0.030% or more and less than 0.20%,
Si: 0.01% or more and 2.0% or less,
Mn: 0.01% or more and 3.0% or less,
P: 0.050% or less,
S: 0.010% or less,
Cr: 10.0% or more and 16.0% or less,
Ni: 0.01% or more and less than 0.20%,
Al: 0.001% or more and 0.50% or less,
Zr: 0.005% or more and 0.50% or less, and
N: 0.030% or more and less than 0.20%, and optionally at least one selected from the group consisting of
Cu: 0.01% or more and 3.0% or less,
Mo: 0.01% or more and 0.50% or less,
Co: 0.01% or more and 0.50% or less,
Ti: 0.001% or more and 0.50% or less,
Nb: 0.001% or more and 0.05% or less,
V: 0.001% or more and 0.50% or less,
B: 0.0002% or more and less than 0.0030%,
Ca: 0.0002% or more and 0.0100% or less, and
Mg: 0.0002% or more and 0.0100% or less, with the balance consisting of Fe and inevitable impurities, wherein the martensitic stainless steel sheet has a tensile strength of 1300 MPa or more, an elongation of 7.0% or more, an ultimate deformability of 0.5 or more, and a structure of the martensitic stainless steel sheet contains, in a volume ratio, 90% or more of martensite.

* * * * *